US007992417B2

(12) United States Patent
Hayashi

(10) Patent No.: US 7,992,417 B2
(45) Date of Patent: Aug. 9, 2011

(54) METHOD FOR PRODUCING ULTRA THIN WALL METALLIC TUBE BY COLD ROLLING METHOD

(75) Inventor: Chihiro Hayashi, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/253,760

(22) Filed: Oct. 17, 2008

(65) Prior Publication Data

US 2009/0145193 A1 Jun. 11, 2009

Related U.S. Application Data

(63) Continuation of application No. PCT/JP2007/073468, filed on Dec. 5, 2007.

(51) Int. Cl.
*B21B 17/10* (2006.01)

(52) U.S. Cl. ..... 72/208; 72/370.14; 72/370.25

(58) Field of Classification Search ..... 72/189, 72/193, 197, 208, 209, 214, 220, 252.5, 96, 72/97, 365.2, 370.14, 370.25
See application file for complete search history.

(56) References Cited

U.S. PATENT DOCUMENTS

| | | | | | |
|---|---|---|---|---|---|
| 3,416,346 | A | * | 12/1968 | Arrington | 72/189 |
| 3,890,821 | A | * | 6/1975 | Gerretz et al. | 72/208 |
| 4,184,352 | A | * | 1/1980 | Potapov et al. | 72/208 |
| 4,658,617 | A | * | 4/1987 | Peytavin | 72/44 |
| 4,819,471 | A | * | 4/1989 | Cook | 72/214 |
| 4,866,968 | A | * | 9/1989 | Cellier et al. | 72/208 |
| 4,966,022 | A | * | 10/1990 | Stinnertz | 72/41 |
| 5,450,741 | A | * | 9/1995 | Baensch et al. | 72/208 |
| 7,197,906 | B2 | * | 4/2007 | Tsuyuguchi et al. | 72/208 |

FOREIGN PATENT DOCUMENTS

| | | | |
|---|---|---|---|
| JP | 62-212006 | * | 9/1987 |
| JP | 62-263804 | * | 11/1987 |
| JP | 63-49309 | * | 3/1988 |
| JP | 01-192405 | | 8/1989 |
| JP | 4-300003 | * | 10/1992 |
| JP | 2006-326651 | | 12/2006 |
| WO | WO-2006/126565 | | 11/2006 |

OTHER PUBLICATIONS

"Steel Bar, Steel Tube, and Rolling Common Facilities," *Iron and Steel Handbooks*., Third Edition, vol. III (2), pp. 1183-1189.
International Search Report in corresponding PCT/JP2007/073468 issued i/Aug. 2008 (Japanese language).
Written Opinion in corresponding PCT/JP2007/073468 issued i/Aug. 2008 Japanese language.
Translation of International Preliminary Report on Patentability and Written Opinion for PCT/JP2007/073468, dated Aug. 10, 2010.

* cited by examiner

*Primary Examiner* — Edward Tolan
(74) *Attorney, Agent, or Firm* — Marshall, Gerstein & Borun LLP

(57) ABSTRACT

An aspect of the present invention provides a method for producing an ultra thin wall metallic tube by a cold rolling method with significant wall thickness reduction. In a method for producing the metallic tube with a cold pilger mill, a wall thickness is reduced to perform elongation while a wall thickness center diameter is expanded using a pair of rolls, which has a tapered groove die whose diameter is gradually expanded or reduced from an engaging inlet side of the roll toward a finishing outlet side thereof, and a tapered mandrel bar, whose diameter is gradually expanded from an engaging inlet side of the tapered mandrel bar toward a finishing outlet side thereof.

2 Claims, 2 Drawing Sheets

FIG. 3A
FIG. 3B
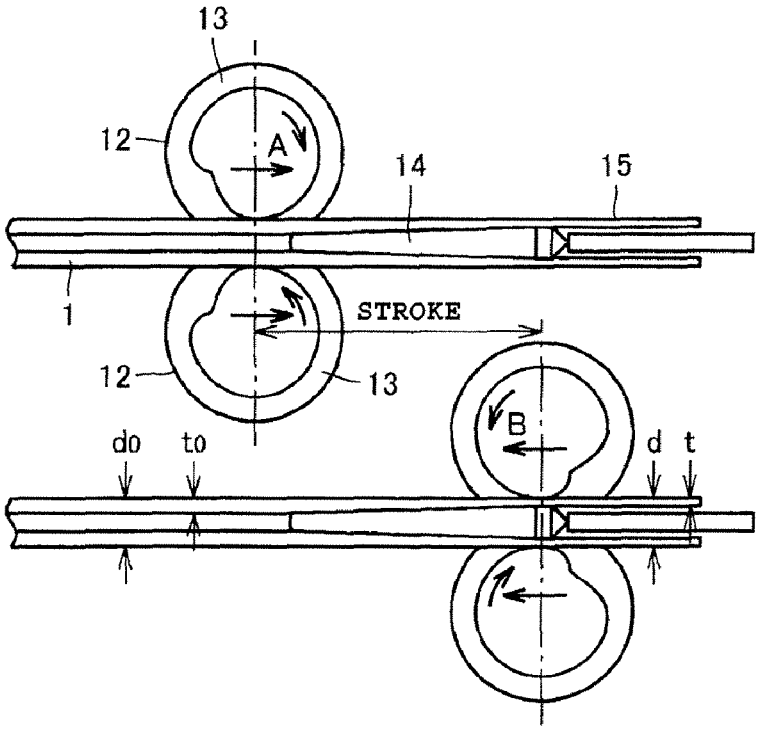
FIG. 4A
FIG. 4B
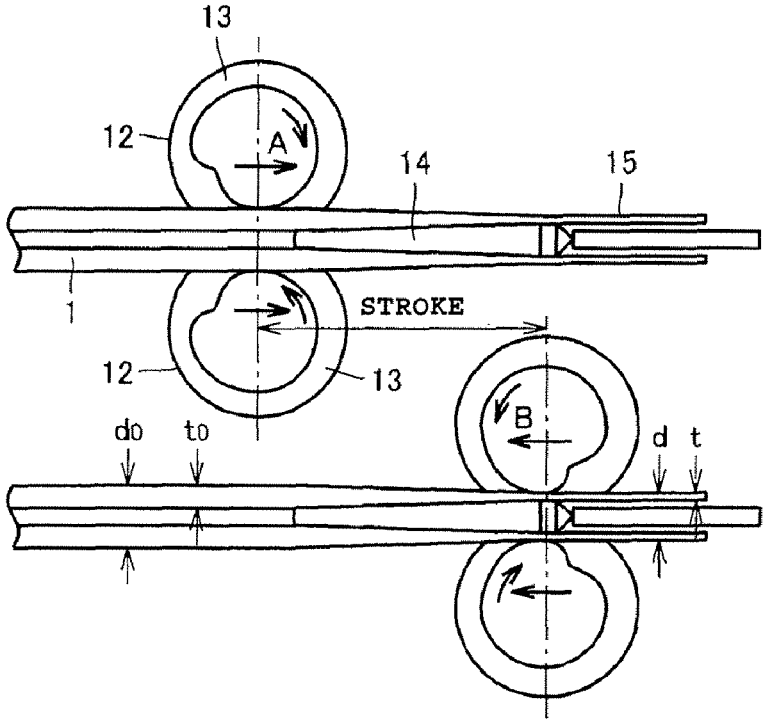

METHOD FOR PRODUCING ULTRA THIN WALL METALLIC TUBE BY COLD ROLLING METHOD

TECHNICAL FIELD

The present invention relates to a cold rolling method for a metallic tube, particularly to a method for producing an ultra thin wall metallic tube by the cold rolling method, in which a producible range is dramatically enlarged on a thin wall side of the metallic tube.

BACKGROUND ART

The metallic tube in a hot finishing state is delivered to a cold working process, when the metallic tube does not satisfy requirements in quality, strength, or dimensional accuracy. Generally, examples of the cold working process include a cold drawing method in which a die and a plug or a mandrel bar are used and a cold rolling method in which a cold pilger mill is used.

In the cold rolling method with the cold pilger mill, diameter reducing rolling is performed to a hollow shell between a pair of rolls having a tapered groove die whose diameter is gradually reduced in a circumferential direction and a tapered mandrel bar whose diameter is also gradually reduced in a lengthwise direction. That is, the groove dies are made in the circumferences of the pair of rolls, and the groove dies have such shapes that the grooves become narrower as the rolls are rotated. The roll is repeatedly advanced and retreated along the tapered mandrel bar while rotated, whereby the rolling is performed to the hollow shell between the roll and the mandrel bar (for example, see "Iron and Steel Handbook third edition" vol. 3, (2) Steel Bar, Steel Tube, and Rolling Common Facilities, pp. 1183 to 1189).

FIG. 1 is a view showing a rolling principle of the cold pilger mill, FIG. 1A is an explanatory view showing a start point of a forward stroke, and FIG. 1B is an explanatory view showing a start point of a backward stroke. As shown in FIG. 1, in the cold pilger mill, a pair of rolls 2, which has a tapered groove die 3 whose diameter is gradually reduced from an engaging inlet side of the roll toward a finishing outlet side thereof, and a tapered mandrel bar 4, whose diameter is gradually reduced from an engaging inlet side of the tapered mandrel bar toward a finishing outlet side thereof, are used according to an outside diameter and a wall thickness (respectively, do and to in the figure) of a hollow shell 1 and an outside diameter and a wall thickness (respectively, t and d in the figure) of a rolled tube 5 of a product, and forward and backward strokes in which the wall thickness is decreased while the diameter of the hollow shell 1 is reduced are repeated.

At the start point of the forward stroke and the start point of the backward stroke in the reciprocating motion, a rotation angle of about 60° and feed ranging from about 5 to about 15 mm are intermittently imparted to the tube material (hollow shell 1), so that the rolling is repeatedly performed to a new portion.

The cold rolling with the cold pilger mill has an extremely high working ratio of the tube material, and about ten-time elongation can be performed. Advantageously, the cold rolling has a large effect of straightening an eccentricity of the wall thickness of the tube, a reducing process is not required, and the cold rolling has a high production yield. At the same time, the cold rolling with the cold pilger mill has a disadvantage of extremely low productivity compared with the cold drawing method. Therefore, the cold rolling with the cold pilger mill is mainly suitable to cold working of high grade tubes, such as a stainless steel tube and a high alloy steel tube, in which raw material cost and intermediate treatment cost are expensive. In a copper and copper alloy fabricated industry, high-efficiency production is realized by three-strand rolling, and the cold pilger mill becomes a core production process for copper and copper alloy fabricated products.

DISCLOSURE OF THE INVENTION

In view of the above problem, an object of the present invention is to propose a method for producing an ultra thin wall metallic tube by a cold working method in which a producible range can significantly be enlarged on the thin wall side of the metallic tube. A thin wall seamless metallic tube is a main target of the present invention, and a welded metallic tube is also included in the target of the present invention because the uneven wall thickness is generated in a welded part or a heat affected zone and the straightening is required even in the thin wall welded metallic tube.

The inventor conducted research and development to solve the above problem based on the issues of the conventional technique, and the inventor obtained the following knowledge to complete the present invention.

Generally, in tube material plastic working, the wall thickness working is achieved by elongating the tube material in a longitudinal direction thereof. That is, in the tube material cold rolling, in the case where the wall thickness working is performed between the groove rolls and the tapered mandrel bar, the rolling is performed while the diameter of the tube is reduced, and the tube material is elongated in a longitudinal direction.

The inventor interpreted the above fact as meaning that the reduction amount of wall thickness is restricted to hardly produce the thin wall thickness tube because the tube material is elongated only in a longitudinal direction when the plastic working is performed to the tube material to reduce the wall thickness, and the inventor had an idea that the above problem could be avoided when the tube material is elongated in a circumferential direction while the tube material is elongated in a longitudinal direction in reducing the wall thickness of the tube material with the cold pilger mill. When the case in which the rolling is performed to a ring shaped product with a ring rolling mill is studied as an extreme case, a ring shaped mother material is elongated not in a longitudinal direction (shaft direction) but only in a circumferential direction of the ring, so that the wall thickness can infinitely be reduced.

In order to elongate the tube material in not only a circumferential direction but also a longitudinal direction using the cold pilger mill, it is necessary that the wall thickness be reduced to perform elongating rolling while the diameter of the tube material is expanded using the tapered roll groove die, whose diameter is gradually expanded or reduced from the engaging inlet side of the roll toward the finishing outlet side thereof, and the tapered mandrel bar, whose diameter is gradually expanded from the engaging inlet side of the tapered mandrel bar toward the finishing outlet side thereof.

The present invention is made based on the above knowledge, and the invention is summarized in a method for producing an ultra thin wall metallic tube by a cold working method shown in items (1) to (3).

(1) A method for producing an ultra thin wall metallic tube by a cold rolling method in which a cold pilger mill is applied, the method characterized in that a wall thickness is reduced to perform elongation while inside and outside diameters are simultaneously expanded using a pair of rolls, which has a tapered groove die whose diameter is gradually expanded from an engaging inlet side of the roll toward a finishing outlet side thereof, and a tapered mandrel bar, whose diameter of the tapered mandrel bar being gradually expanded from an engaging inlet side of the tapered mandrel bar toward a finishing outlet side thereof, according to outside diameters and wall thicknesses of a hollow shell and a finishing rolled tube. In this case, it is obvious that the wall thickness cannot be reduced unless an expansion margin of the inside diameter is set larger than that of the outside diameter.

(2) The plastic deformation in which the wall thickness is reduced while the inside and outside diameters are simultaneously expanded is described in the item (1). However, the plastic deformation in which the inside and outside diameters are simultaneously expanded is not always referred to as the diameter expansion deformation of the tube material. From the viewpoint of mechanics of plasticity, the plastic deformation in which a wall thickness center diameter (average diameter of the inside and outside diameters) of the tube material is expanded is collectively referred to as the diameter expansion deformation.

Accordingly, even if only the inside diameter is expanded while the outside diameter is not changed, the diameter expansion deformation is realized because the wall thickness center diameter is surely expanded.

(3) Even if the outside diameter is reduced, the wall thickness center diameter is expanded to perform the diameter expansion deformation when an expansion margin of the inside diameter is larger than a reduction margin of the outside diameter.

As used herein, an expansion ratio of an inside diameter or an outside diameter shall mean a ratio in which an inside or outside diameter of a metallic tube after cold rolling is divided by an inside or outside diameter of the metallic tube before cold rolling, and a reduction ratio of an outside diameter shall mean that the expansion ratio of the outside diameter is not more than one.

BRIEF DESCRIPTION OF THE DRAWINGS

FIG. 1 is an explanatory view of a conventional diameter reducing rolling method.

FIG. 2 is an explanatory view of a diameter expansion rolling method according to the present invention in which a wall thickness is reduced to perform elongation while inside and outside diameters are simultaneously expanded.

FIG. 3 is an explanatory view of a diameter expansion rolling method according to the present invention in which a wall thickness is reduced to perform elongation at the same time when the inside diameter is expanded while the outside diameter is not changed, FIG. 3A shows a start point of a forward stroke, and FIG. 3B shows a start point of a backward stroke; and FIG. 4 is an explanatory view of a diameter expansion rolling method according to the present invention in which the wall thickness is reduced to perform elongation at the same time when the inside diameter is expanded while the outside diameter is reduced, FIG. 4A shows a start point of a forward stroke, and FIG. 4B shows a start point of a backward stroke.

BEST MODES FOR CARRYING OUT THE INVENTION

As described above, the present invention is a method for producing an ultra thin wall metallic tube by a cold rolling method with a cold pilger mill.

A first aspect of the present invention is a method for producing an ultra thin wall metallic tube by a cold rolling method in which a cold pilger mill is applied, and the method is characterized in that a wall thickness is reduced to perform elongating rolling while inside and outside diameters are simultaneously expanded using a pair of rolls, which has a tapered groove die whose diameter is gradually expanded from an engaging inlet side of the roll toward a finishing outlet side thereof, and a tapered mandrel bar, whose diameter is gradually expanded from an engaging inlet side of the tapered mandrel bar toward a finishing outlet side thereof.

Figure 1A:
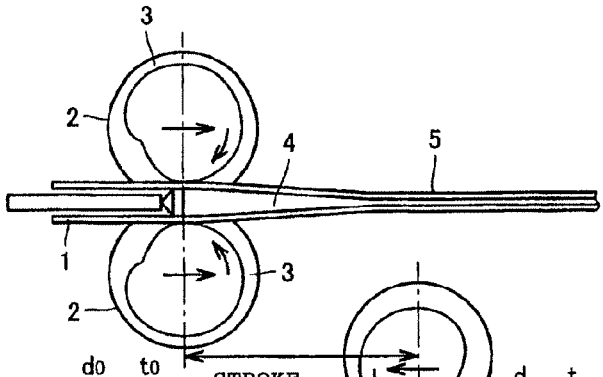
FIG. 1A shows a start point of a forward stroke.
Figure 1B:
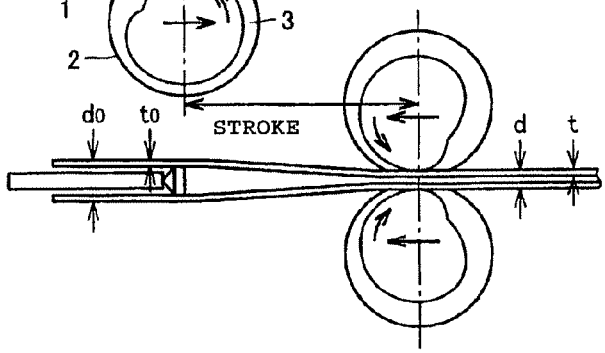
PRIOR ART FIG. 1B
FIG. 1B shows a start point of a backward stroke.
Figure 2A:
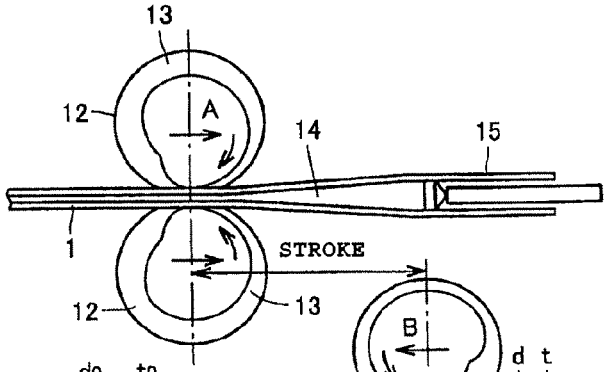
PRIOR ART FIG. 2A
FIG. 2A shows a start point of a forward stroke.
Figure 2B:
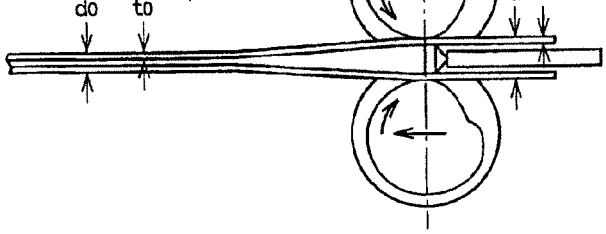
FIG. 2B shows a start point of a backward stroke.

FIG. 2 shows the aspect according to the present invention. FIG. 2A shows a start point of a forward stroke and FIG. 2B shows a start point of a backward stroke. As shown in FIG. 2A, a tapered groove die 13 whose diameter is smoothly expanded from the engaging inlet side thereof toward the finishing outlet side thereof is provided around each of a pair of rolls 12, and the pair of rolls 12 is advanced in a direction shown by an arrow A in the figure along a tapered mandrel bar 14 whose outside diameter is smoothly expanded from the engaging inlet side thereof toward the finishing outlet side thereof, whereby elongating rolling is performed to a hollow shell 1 between a surface of the tapered groove die 13 of the roll 12 and a surface of the tapered mandrel bar 14. Then, as shown in FIG. 2B, the pair of rolls 12 is reversely rotated, and elongating rolling is similarly performed to the hollow shell 1 between the tapered groove die 13 of the roll 12 and the tapered mandrel bar 14 while the pair of rolls 12 is retreated in a direction shown by an arrow B in the figure.

By repetition of the above forward and backward strokes, the hollow shell 1 having an outside diameter do and a wall thickness to is rolled into a rolled tube product 15 having an outside diameter d and a wall thickness t while the diameter of the hollow shell 1 is expanded. In the start point of the forward stroke and the start point of the backward stroke in the reciprocating motion, the tube material (hollow shell 1) feeding and turning method to be performed is similar to the conventional technique.

A second aspect of the present invention is a method for producing an ultra thin wall metallic tube with a cold pilger mill, in which the wall thickness is reduced to perform elongation at the same time when only the inside diameter is expanded while the outside diameter is not changed. A third aspect of the present invention is a method for producing an ultra thin wall metallic tube with a cold pilger mill, in which the wall thickness is reduced to perform elongation at the same time when the outside diameter is reduced and the inside diameter is expanded while an expansion margin of the inside diameter is set larger than a reduction margin of the outside diameter. FIGS. 3 and 4 show the second and third aspects according to the present invention. FIGS. 3A and 4A show each a start point of a forward stroke and FIGS. 3B and 4B show each a start point of a backward stroke. The hollow shell 1 is elongated and rolled between the tapered groove dies 13 of the rolls 12 and the tapered mandrel bar 14 by the same manner as described in FIG. 2.

EXAMPLES

The following tests were performed for three examples and the results were evaluated in order to confirm the effects of the methods for producing an ultra thin wall metallic tube by the cold rolling method according to the present invention.

First Example

A 18% Cr-8% Ni stainless steel tube having an outside diameter of 34.0 mm and a wall thickness of 3.5 mm produced by the Mannesman-mandrel mill process was used as the hollow shell for test specimen, the hollow shell was rolled while the diameter thereof was expanded using the cold pilger mill, and the obtained tube had an outside diameter of 50.8 mm and a wall thickness of 1.3 mm.

The test conditions and results are summarized as follows.

Diameter of tapered roll groove die: D ranging from 34.0 to 50.8 mm

Diameter of tapered mandrel bar: dm ranging from 26.0 to 47.2 mm

Feed: f=10.0 mm

Turn angle: θ=60°

Hollow shell outside diameter: do=34.0 mm

Hollow shell wall thickness: to =3.5 mm

Outside diameter of tube after rolling: d=50.8 mm

Wall thickness of tube after rolling: t=1.3 mm

Expansion ratio of outside diameter: d/do=1.49

Elongation ratio: to(do−to)/{t(d−t)}=1.66

(Wall thickness/Outside diameter) ratio: t/d=2.56%

Expansion ratio of wall thickness center diameter: (d−t)/(do−to)=1.62

Second Example

A 18% Cr-8% Ni stainless steel tube having an outside diameter of 50.8 mm and a wall thickness of 4.5 mm produced by the Mannesman-mandrel mill process was used as the hollow shell for test specimen, the hollow shell was rolled while the diameter thereof was expanded using the cold pilger mill, and the obtained tube had an outside diameter of 50.8 mm and a wall thickness of 1.5 mm.

The test conditions and results are summarized as follows.

Diameter of tapered roll groove die: D ranging from 50.8 to 50.8 mm

Diameter of tapered mandrel bar: dm ranging from 40.8 to 47.8 mm

Feed: f=10.0 mm

Turn angle: θ=60°

Hollow shell outside diameter: do=50.8 mm

Hollow shell wall thickness: to =4.5 mm

Outside diameter of tube after rolling: d=50.8 mm

Wall thickness of tube after rolling: t=1.5 mm

Expansion ratio of outside diameter: d/do=1.0

Elongation ratio: to(do−to)/{t(d−t)}=2.82

(Wall thickness/Outside diameter) ratio: t/d=2.95%

Expansion ratio of wall thickness center diameter: (d−t)/(do−to)=1.06

Third Example

A 18% Cr-8% Ni stainless steel tube having an outside diameter of 53.4 mm and a wall thickness of 5.5 mm produced by the Mannesman-mandrel mill process was used as the hollow shell for test specimen, the hollow shell was rolled while the diameter thereof was expanded using the cold pilger mill, and the obtained tube had an outside diameter of 50.8 mm and a wall thickness of 1.7 mm.

The test conditions and results are summarized as follows.

Diameter of tapered roll groove die: D ranging from 53.4 to 50.8 mm

Diameter of tapered mandrel bar: dm ranging from 41.4 to 47.4 mm

Feed: f=10.0 mm

Turn angle: θ=60°

Hollow shell outside diameter: do=53.4 mm

Hollow shell wall thickness: to=5.5 mm

Outside diameter of tube after rolling: d=50.8 mm

Wall thickness of tube after rolling: t=1.7 mm

Reduction ratio of outside diameter: d/do=0.95

Elongation ratio: to(do−to)/{t(d−t)}=3.16

(Wall thickness/Outside diameter) ratio: t/d=3.35%

Expansion ratio of wall thickness center diameter: (d−t)/(do−to)=1.03

The steel tube obtained by the tests of three examples had glossy inner and outer surface textures, and there was no particular trouble in quality. In the 18% Cr-8% Ni stainless steel tube having the outside diameter of 50.8 mm, because the minimum wall thickness up to from about 2.0 mm to about 2.5 mm can be cold-rolled by the conventional diameter reducing rolling method, it is clear that the diameter expansion rolling method according to the present invention has the significant advantage.

INDUSTRIAL APPLICABILITY

The use of the method for producing an ultra thin wall metallic tube by the cold rolling method of the present invention can significantly enlarge the producible range on the thin wall side of the metallic tube by the cold working method. When the seamless metallic tube having the wall thickness less than about two-thirds of the conventional cold-finishing seamless metallic tube is economically stably produced by the method of the present invention, thin wall welded metallic tubes such as a TIG welded tube and a laser welded tube can be replaced with the high-reliability ultra thin wall seamless metallic tube produced by the method of the present invention. When the ultra thin wall seamless metallic tube having the wall thickness of 0.6 to 0.8 mm is stably produced, the ultra thin wall seamless metallic tube can be applied to high-technology fields such as a heating sleeve of a color laser printer, a pressurizing roll of the color laser printer, and a cell case of a fuel cell.

What is claimed is:

1. A method for producing an ultra thin wall metallic tube by a cold rolling method in which a cold pilger mill is applied, using a pair of rolls, which has a tapered groove die whose diameter is gradually reduced from an engaging inlet side of the roll toward a finishing outlet side thereof and a tapered mandrel bar, whose diameter is gradually expanded from an engaging inlet side toward a finishing outlet side thereof, according to outside diameters and wall thicknesses of a hollow shell and a finishing rolled tube, wherein the wall thickness is reduced to perform elongation at the same time when the outside diameter is reduced and the inside diameter is expanded while an expansion margin of the inside diameter is set larger than a reduction margin of the outside diameter and a wall thickness center diameter, which is an average diameter of the outside and inside diameter, is expanded.

2. The method for producing an ultra thin wall metallic tube according to claim 1, wherein the wall thickness is reduced to perform elongation at the same time when only the inside diameter is expanded while the outside diameter is not changed with the reduction margin thereof being nil.

* * * * *